US009666034B2

(12) United States Patent
Nakamura

(10) Patent No.: US 9,666,034 B2
(45) Date of Patent: May 30, 2017

(54) SYSTEM AND METHOD OF ALLOWING A PLAYER TO PLAY GAMING MACHINES HAVING STEP-BASED CHANGES AND MULTIPLE PATTERN FEATURES

(71) Applicant: Konami Gaming, Inc., Las Vegas, NV (US)

(72) Inventor: Daisuke Nakamura, Zama (JP)

(73) Assignee: KONAMI GAMING, INC., Las Vegas, NV (US)

( * ) Notice: Subject to any disclaimer, the term of this patent is extended or adjusted under 35 U.S.C. 154(b) by 246 days.

(21) Appl. No.: 14/326,247

(22) Filed: Jul. 8, 2014

(65) Prior Publication Data

US 2015/0080103 A1 Mar. 19, 2015

(30) Foreign Application Priority Data

Sep. 19, 2013 (AU) ..... 2013231092

(51) Int. Cl.
*A63F 9/24* (2006.01)
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ... G07F 17/34; G07F 17/3213; G07F 17/3227
See application file for complete search history.

(56) References Cited

U.S. PATENT DOCUMENTS

| | | | |
|---|---|---|---|
| 5,833,537 | A | 11/1998 | Barrie |
| 5,984,781 | A | 11/1999 | Sunaga |
| 6,731,313 | B1 | 5/2004 | Kaminkow |
| 7,674,175 | B2 | 3/2010 | Yoshimura |

(Continued)

FOREIGN PATENT DOCUMENTS

| | | |
|---|---|---|
| AU | WO 2008052241 A1 * | 5/2008 |
| JP | 2003199206 | 7/2003 |
| JP | 2005246197 | 8/2005 |

OTHER PUBLICATIONS

Patent Examination Report No. 1; Issue date: Nov. 15, 2013; Australia.

(Continued)

*Primary Examiner* — Steve Rowland
(74) *Attorney, Agent, or Firm* — Howard & Howard Attorneys PLLC

(57) ABSTRACT

The invention is directed to a gaming system and method of providing a game. The system is configured to display a plurality of symbol positions displayed on a grid. The grid defines a plurality of columns having an associated reel, reel strip, a plurality of symbol positions and game symbols displayed in each of the symbol positions in a predetermined order defining a reel layout. The method includes: initiating a game; establishing a first and second interval comprising at least two spins of the reels, the reel strip associated one of the reels has a first reel layout used during the spins of the first interval; and changing the pattern of the reel strip of one reel strip at the end of the first interval, before initiating the second interval, to a second reel layout, wherein the second reel layout is used for the spins of the second interval.

9 Claims, 9 Drawing Sheets

(56) References Cited

U.S. PATENT DOCUMENTS

| | | | | |
|---|---|---|---|---|
| 8,029,354 | B2 | 10/2011 | Saito | |
| 8,382,577 | B2 | 2/2013 | Teranishi | |
| 8,529,332 | B2 * | 9/2013 | Bennett | G07F 17/3267 463/16 |
| 2002/0039919 | A1 * | 4/2002 | Joshi | G07F 17/32 463/20 |
| 2003/0134673 | A1 * | 7/2003 | Moody | G07F 17/3267 463/20 |
| 2004/0033827 | A1 | 2/2004 | Gilmore et al. | |
| 2004/0092300 | A1 | 5/2004 | Gauselmann | |
| 2005/0239539 | A1 * | 10/2005 | Inamura | G07F 17/3265 463/20 |
| 2005/0282607 | A1 * | 12/2005 | Gauselmann | G07F 17/32 463/16 |
| 2006/0073876 | A1 * | 4/2006 | Cuddy | G07F 17/3244 463/20 |
| 2006/0183534 | A1 * | 8/2006 | Yoshimi | G07F 17/34 463/20 |
| 2007/0060256 | A1 * | 3/2007 | Yoshimura | G07F 17/32 463/16 |
| 2007/0167215 | A1 | 7/2007 | Majima et al. | |
| 2007/0232382 | A1 * | 10/2007 | Berman | G07F 17/32 463/20 |
| 2010/0087243 | A1 | 4/2010 | Saito et al. | |
| 2012/0083327 | A1 * | 4/2012 | Zobel | G07F 17/34 463/20 |
| 2012/0295688 | A1 | 11/2012 | Watkins | |
| 2012/0302323 | A1 * | 11/2012 | Gagner | G07F 17/3202 463/25 |

OTHER PUBLICATIONS

Patent Examination Report No. 2; Issue date: Jan. 29, 2014; Australia.

Patent Examination Report No. 3; Issue date: May 22, 2014; Australia.

Japanese Office Action (2014-147018); Dated: Jul. 16, 2015.

* cited by examiner

| Step1 | Step2 | Step3 | Step4 | Step5 |
|---|---|---|---|---|
| PIC-a | PIC-a | PIC-a | PIC-a | PIC-a |
| 9 | 9 | 9 | 9 | 9 |
| Wild | Wild | Wild | Wild | Wild |
| Wild | Wild | Wild | Wild | Wild |
| Wild | Wild | Wild | Wild | Wild |
| 10 | 10 | 10 | 10 | 10 |
| J | J | J | J | J |
| K | Wild | Wild | Wild | Wild |
| 9 | Wild | Wild | Wild | Wild |
| PIC-b | Wild | Wild | Wild | Wild |
| K | K | K | K | K |
| J | 9 | 9 | 9 | 9 |
| PIC-d | PIC-b | Wild | Wild | Wild |
| Q | K | Wild | Wild | Wild |
| Inner | J | Wild | Wild | Wild |
| Inner | PIC-d | PIC-b | PIC-b | PIC-b |
| Inner | Q | K | K | K |
| Inner | Inner | J | Wild | Wild |
| Inner | Inner | PIC-d | Wild | Wild |
| Inner | Inner | Q | Wild | Wild |
| Inner | Inner | Inner | J | J |
| Inner | Inner | Inner | PIC-d | PIC-d |
| Inner | Inner | Inner | Q | Wild |
| Inner | Inner | Inner | Inner | Wild |
| Inner | Inner | Inner | Inner | Wild |
| Inner | Inner | Inner | Inner | Q |
| Inner | Inner | Inner | Inner | Inner |
| Inner | Inner | Inner | Inner | Inner |
| PIC-e | PIC-e | PIC-e | PIC-e | PIC-e |
| Scatter | Scatter | Scatter | Scatter | Scatter |
| A | A | A | A | A |
| PIC-c | PIC-c | PIC-c | PIC-c | PIC-c |
| Wild | Wild | Wild | Wild | Wild |

607
605
601
602
606
602A
605
602B
605
602C
604
605
602D
603

FIG. 6

| Step1 | Step2 | Step3 | Step4 | Step5 |
|---|---|---|---|---|
| K | K | K | Wild | Wild |
| PIC-b | PIC-b | PIC-b | Wild | Wild |
| J | J | J | Wild | Wild |
| PIC-d | PIC-d | PIC-d | PIC-d | PIC-d |
| 10 | 10 | 10 | 10 | 10 |
| PIC-c | PIC-c | Wild | Wild | Wild |
| 9 | 9 | Wild | Wild | Wild |
| PIC-e | PIC-e | Wild | Wild | Wild |
| J | J | J | J | J |
| PIC-c | PIC-c | PIC-c | PIC-c | PIC-c |
| Scatter | Scatter | Scatter | Scatter | Scatter |
| A | A | A | A | A |
| PIC-e | PIC-e | PIC-e | PIC-e | PIC-e |
| J | Wild | Wild | Wild | Wild |
| PIC-a | Wild | Wild | Wild | Wild |
| K | Wild | Wild | Wild | Wild |
| 10 | 10 | 10 | 10 | 10 |
| PIC-c | PIC-c | PIC-c | PIC-c | PIC-c |
| Wild | Wild | Wild | Wild | Wild |
| Wild | Wild | Wild | Wild | Wild |
| Wild | Wild | Wild | Wild | Wild |
| J | J | J | J | J |
| PIC-b | PIC-b | PIC-b | PIC-b | PIC-b |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| INNER | INNER | INNER | INNER | INNER |
| PIC-e | PIC-e | PIC-e | PIC-e | PIC-e |
| K | K | K | K | K |
| PIC-c | PIC-c | PIC-c | PIC-c | Wild |
| 10 | 10 | 10 | 10 | Wild |
| PIC-e | PIC-e | PIC-e | PIC-e | Wild |
| Q | Q | Q | Q | Q |
| PIC-a | PIC-a | PIC-a | PIC-a | PIC-a |
| 9 | 9 | 9 | 9 | 9 |
| Wild | Wild | Wild | Wild | Wild |
| A | A | A | A | A |
| PIC-c | PIC-c | PIC-c | PIC-c | PIC-c |

601

607

606

602

605

603

604

FIG. 7

SYSTEM AND METHOD OF ALLOWING A PLAYER TO PLAY GAMING MACHINES HAVING STEP-BASED CHANGES AND MULTIPLE PATTERN FEATURES

CROSS REFERENCE TO RELATED APPLICATION

This application claims priority to Australian Patent Application No. 2013231092, filed Sep. 19, 2013, the disclosure of which is hereby incorporated by reference in its entirety.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The invention generally relates to gaming machines and more particularly, to an apparatus and method for allowing players to play gaming machines having step/interval based changes within gameplay and multiple pattern features.

BACKGROUND OF THE INVENTION

Gaming machines, such as slot machines, are a cornerstone of the gaming industry. At least some known gaming machines include a video display device to display a reel game that includes a plurality of reels, wherein each reel includes a plurality of symbols. During game play, the gaming machine accepts a wager from a player, the player selects one or more paylines, the gaming machine spins the reels, and sequentially stops each reel to display the generated combination of symbols on the reels. The gaming machine then awards the player an award based on the combination of symbols orientated along the selected payline.

Some known gaming machines have a plurality of symbols displayed on their reels and utilize one unified pattern over the course of gameplay. This unified pattern progresses over time in order to provide interactive gameplay to the player. Further, additional symbols may be used in order to alter this pattern over time based on certain triggers in a game.

The present invention is aimed at one or more of the problems identified above.

BRIEF SUMMARY OF INVENTION

In one aspect of the aspect of the present invention, a method of providing a game to a player is described. The game has a display configured to display a plurality of symbol positions displayed on a grid. The grid defines a plurality of columns, each column having an associated reel, each reel having an associated reel strip, each reel strip including a plurality of symbol positions and a plurality of game symbols displayed in each of the symbol positions in a predetermined order defining a reel layout. The method then includes the steps of: initiating a game; establishing a first interval and a second interval within the game, each interval comprising at least two spins of the reels, where the reel strip associated with at least one of the reels has a first reel layout used during the spins of the first interval; and changing the pattern of the reel strip of the at least one reel strip at the end of the first interval, prior to initiation of the second interval, to a second reel layout, wherein the second reel layout is used for the spins of the second interval.

In another aspect of the present invention, a system for providing a game to a player is provided. The game has a display configured to display a plurality of symbol positions displayed on a grid. The grid defines a plurality of columns, each column having an associated reel, each reel having an associated reel strip, each reel strip including a plurality of symbol positions and a plurality of game symbols displayed in each of the symbol positions in a predetermined order defining a reel layout. The system is then further configured to: initiate a game; establish a first interval and a second interval within the game, each interval comprising at least two spins of the reels, where the reel strip associated with at least one of the reels has a first reel layout used during the spins of the first interval; and change the pattern of the reel strip of the at least one reel strip at the end of the first interval, prior to initiation of the second interval, to a second reel layout, wherein the second reel layout is used for the spins of the second interval.

In another aspect of the present invention, a non-transitory information recording medium containing a computer readable program is provided that functions as a system for providing a game to a player. The game has a display configured to display a plurality of symbol positions displayed on a grid. The grid defines a plurality of columns, each column having an associated reel, each reel having an associated reel strip, each reel strip including a plurality of symbol positions and a plurality of game symbols displayed in each of the symbol positions in a predetermined order defining a reel layout. The system is then further configured to: initiate a game; establish a first interval and a second interval within the game, each interval comprising at least two spins of the reels, where the reel strip associated with at least one of the reels has a first reel layout used during the spins of the first interval; and change the pattern of the reel strip of the at least one reel strip at the end of the first interval, prior to initiation of the second interval, to a second reel layout, wherein the second reel layout is used for the spins of the second interval.

BRIEF DESCRIPTION OF THE DRAWINGS

Other advantages of the present invention will be readily appreciated as the same becomes better understood by reference to the following detailed description when considered in connection with the accompanying drawings:

FIG. 6 is a schematic representation of a pattern of symbols utilized during step-wise leveling performed by the game system, according to an embodiment of the present invention;

FIG. 7 is a schematic representation of a pattern of symbols utilized during step-wise leveling performed by the game system, according to an embodiment of the present invention;

Corresponding reference characters indicate corresponding parts throughout the drawings.

DETAILED DESCRIPTION OF THE INVENTION

Figure 1:
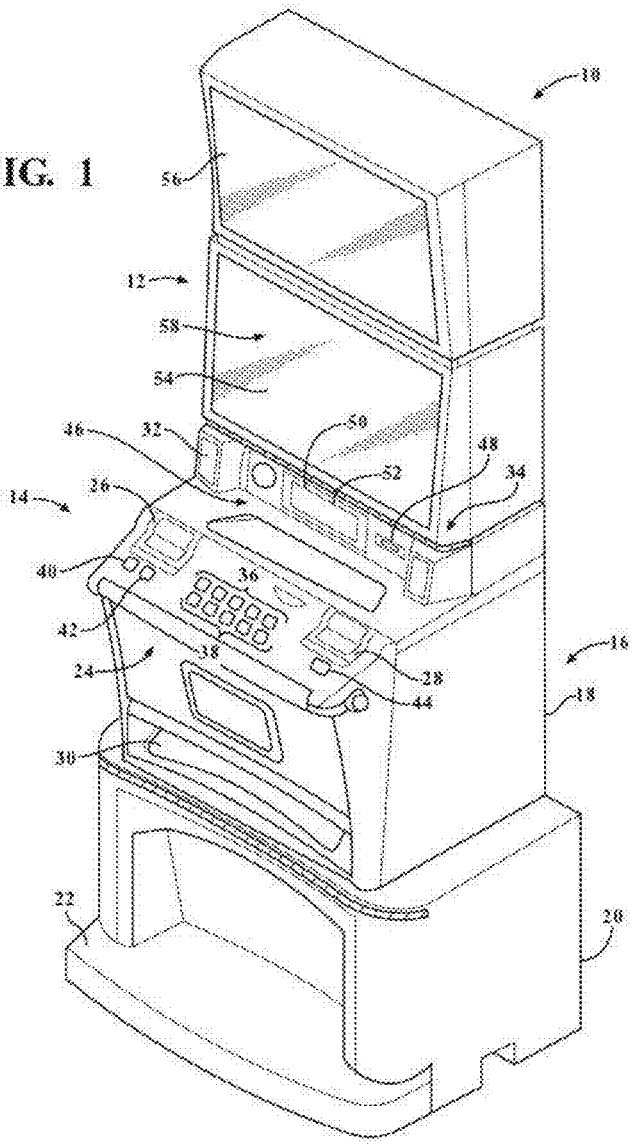
FIG. 1 is a perspective view of an exemplary gaming machine for use in the system of FIG. 1.

With reference to the drawings and in operation, the present invention overcomes at least some of the disadvantages of known gaming machines by providing a step-based and multiple-pattern game play sequence over the course of a game. More specifically, the gaming machine determines a series of intervals based on a predetermined game trigger. The game machine will then proceed to alter at least two separate sets of symbol patterns over the course of these intervals. These changes involves equal increases and decrease of gaming symbols and symbol types 88 and can alternatively involve overriding symbol positions or maintaining certain symbol positions over the course of these predetermined intervals. This creates a more interactive and randomized game experience, enhancing the player's expectation for achieving a win and the improving the enjoyment of the game. Thus, the amount of time that the game is played by patrons of a gaming establishment is increased.

In general, the gaming machine 10 allows a player to initiate a gaming session to play a plurality of video slot games via the gaming machine 10. The gaming machine 10 displays a game, accepts a wager on the game, generates a game outcome including a plurality of gaming symbols 88 at a plurality of symbol positions 112, and provides an award to the player if a winning combination is displayed in the generated game outcome. During play of the game, the gaming machine 10 detects a particular trigger condition and generates a particular number of game intervals in relation to that trigger. Those intervals are then established on the game machine prior to continuing any game play on the game machine 10. Then, the machine determines the initial number of symbols or symbol types that are must change over the course of the intervals determined by the game machine 10. The game machine 10 then proceeds through the first interval using a pattern for each reel in play, utilizing at least two different patterns for all reels 98 currently in use. After the first interval, the gaming machine 10 will then change the amount of the gaming symbols or symbol types 88 within the reel 98 by increasing and/or decreasing certain symbols or symbol types 88 along the reels 98. The symbol position 112 held by the game symbol 88 may also be altered along the reel 98. The final patterns are then maintained after the final interval is finished and until the end of the particular segment of game play.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Gaming Machine

Figure 2:
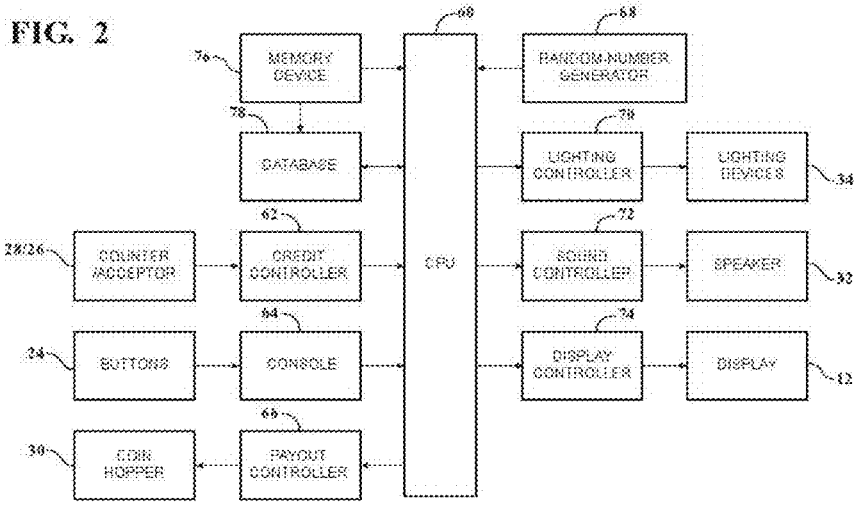
FIG. 2 is a schematic showing the structure of the gaming machine shown in FIG. 1.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 10. One or more speakers 32 are installed inside the cabinet assembly 18 to generate voice announcements and/or sound effects associated with game play. The gaming machine 10 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 10.

The gaming machine 10 may also include a player tracking device 46 that is coupled to the gaming controller 16 for identifying the player and/or a player tracking account that is associated with the player. The player tracking account may include, but is not limited to, gaming credits available to the player for use in playing the gaming machine 10. The player tracking device 46 is configured to communicate player account information between a player tracking controller (not shown) and the gaming machine 10. For example, the player tracking device 46 may be used to track bonus points and/or credits awarded to the player during a gaming session and/or track bonus and/or credits downloaded to the gaming machine 10 from the player tracking system.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 10 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 12.

In one embodiment, the display device 12 includes a first display 54 and a second display 56. The first display 54 is configured to display a game screen 58 (shown in FIG. 3) including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 10 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 2, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, pay tables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 10, such as the booting operation thereof.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produces lighting effects associated with game play. The sound controller 72 controls the speakers 32 to output voice announcements and sound effects during game play. The display controller 74 controls the display device 12 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 3:
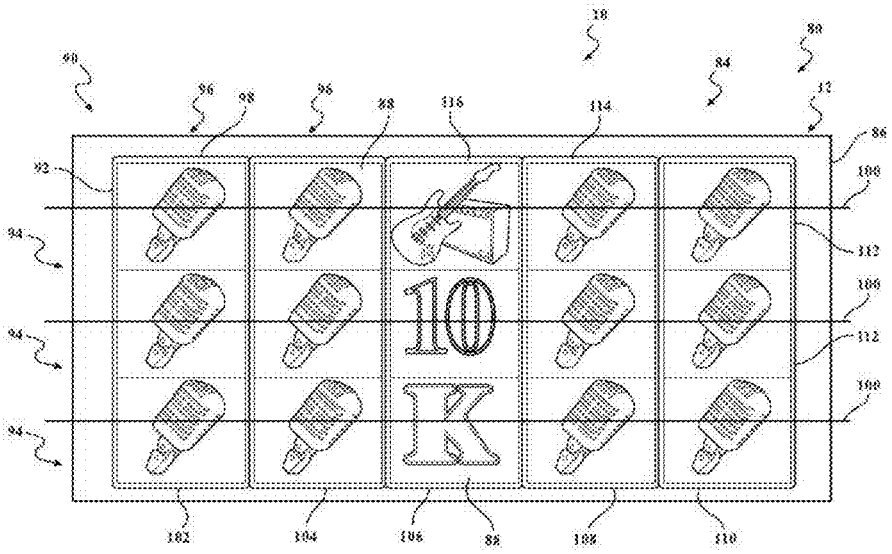
FIG. 3 is a graphical display of a video slot game including a plurality of reels, according to an embodiment of the present invention.
Figure 4:
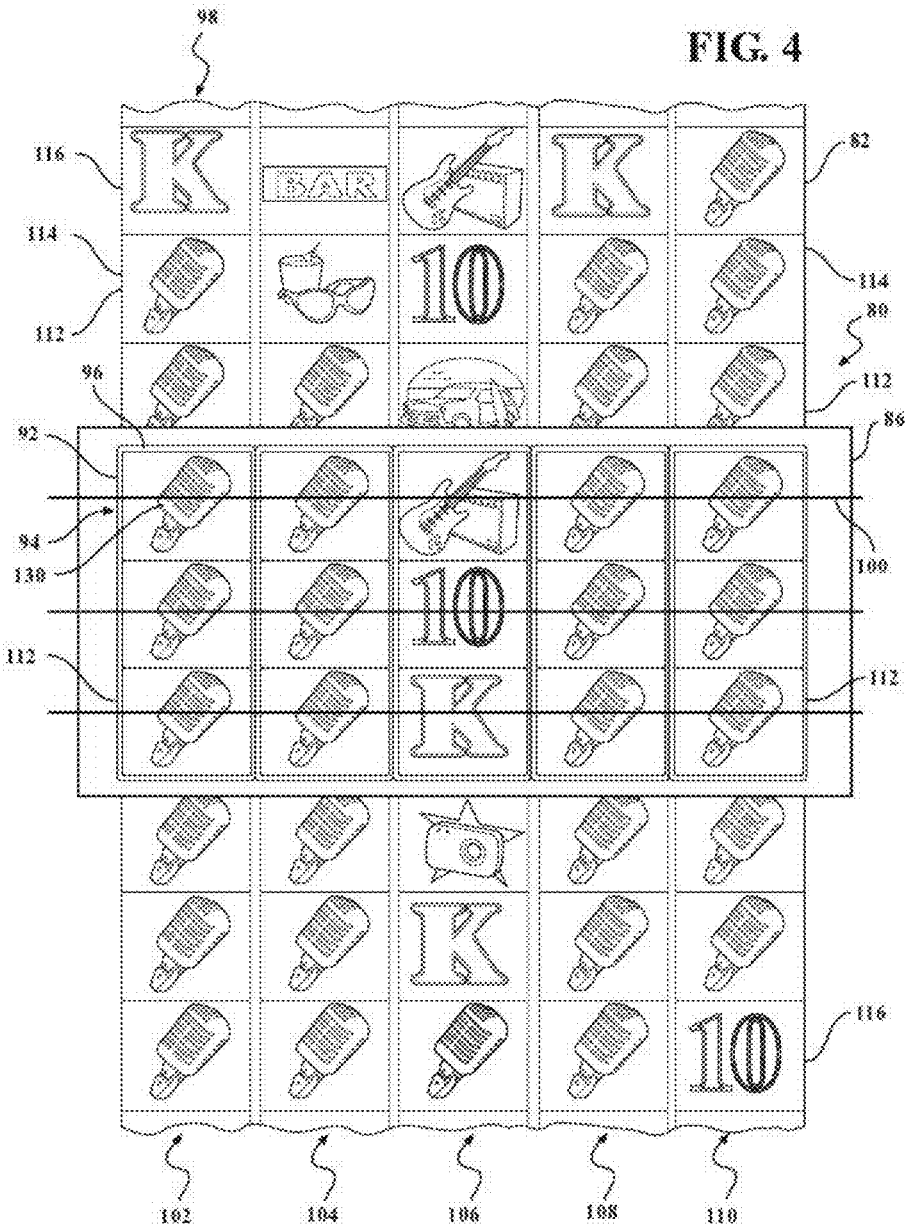
FIG. 4 is a schematic representation of a portion of the gaming machine shown in FIG. 1 including the video slot game of FIG. 3, according to an embodiment of the present invention.
Figure 5:
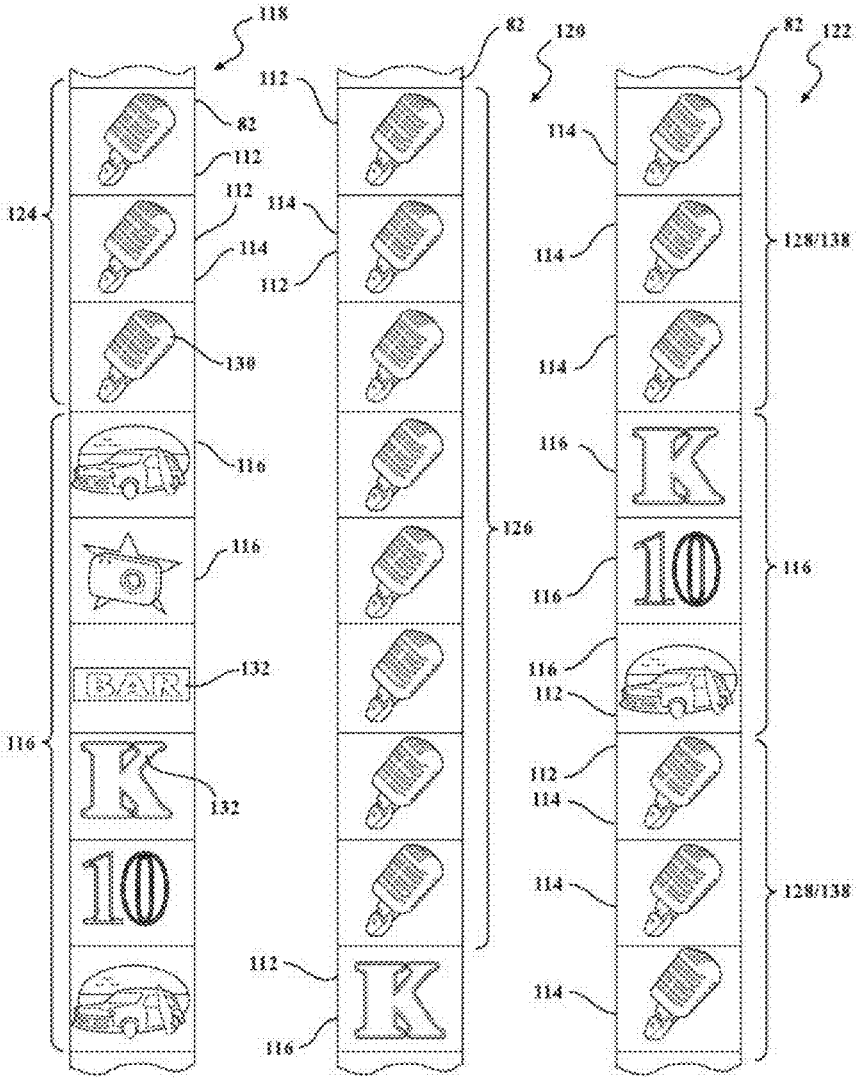
FIG. 5 is a schematic representation of a plurality of reel strips that may be used with at least one slot reel of the video slot game of FIGS. 3 and 4, according to an embodiment of the present invention.

FIG. 3 is an exemplary graphical display of a game 80 that is displayed by the gaming machine 10 shown in FIG. 1. FIG. 4 is a schematic representation of a portion of the gaming machine 10 including the game 80. FIG. 5 is a schematic representation of a plurality of reel strips 82 that may be used the game 80 shown in FIG. 3. In the illustrated embodiment, the gaming controller 16 is configured to display the game 80 on the display device 12. In one embodiment, the game 80 is a video slot game. However, it should be noted that the game 80 may be any type of game upon which a player could make a wager including, but not limited to a keno game, a blackjack game, a video poker game, or any type of game that enables the gaming machine 10 to function as described herein. In the illustrated embodiment, the game 80 is displayed on the first display 54. Alternatively, the game 80 may be displayed on the first display 54 and/or the second display 56.

In general, during play of the main game 80, the gaming controller 16 randomly generates an outcome 84 of the main game 80 and displays the generated game outcome 84 in a display area 86. The gaming controller 16 randomly selects a plurality of game symbols 88 from a predefined set of possible game symbols and displays the selected game symbols 88 associated with the generated game outcome 84 in the game display area 86.

In the illustrated embodiment, the plurality of game symbols 88 are displayed in a grid 90 having a plurality of cells 92 arranged along a plurality of rows 94 and a plurality of columns 96. Each cell 92 displays one or more game symbols 88 associated with the game outcome 84. In the illustrated embodiment, the gaming controller 16 displays the game symbols 88 within a plurality of reels 98. Each reel 98 is associated with a corresponding column 96. The main game 80, in one embodiment, includes 5 reels 98 with 3 cells 92 displayed in the display area 86 per reel 98 (a "3×5" arrangement). Alternatively, other reel arrangements may be used such as, for example, 4, 5, 5, 5, and 4 cells per reel, respectively (a "4-5-5-5-4" arrangement), 3-4-3-4-3, or 4-5-4-5-4 arrangements or arrangements with the same number of cells per column, such as 3×3, 3×4, 4×5, or 5×5 configurations. The main game 80 also includes a plurality of paylines 100 that extend across one or more cells 92 to indicate, to the player, a combination of game symbols 88. In one embodiment, the gaming machine 10 displays the main game 80 via a plurality of mechanical reels (not shown) that include a plurality of symbols displayed on a circumferential surface of each reel.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 88 in each of the display cells 92. If a predetermined pattern of symbols 88 is randomly chosen for each cell 92 associated with a played payline 100, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 84. Many variations to the above described general play of a slot game fall within the scope of the present invention. Such slot games are well-known in the art, and are therefore not further discussed.

In the illustrated embodiment, the gaming machine 10 receives a signal, from the user input device 14, that is indicative of a player's selection to initiate a gaming session including a wager amount, and a selection of one or more paylines 100 associated with a predefined set of cells 92 within the displayed grid 90. In the illustrated embodiment, the gaming machine 10 is a multi-line game, i.e., the paylines include horizontal paylines and/or diagonal paylines, and/or zig-zag paylines. Moreover, the user input device 14 may allow the player to toggle to increase the bet per payline a credit at a time (up to the maximum bet). The gaming controller 16 randomly generates an outcome of the main game 80, and displays the generated outcome on the display device 12. In one embodiment, the gaming controller 16 is configured to rotate, and/or spin each reel 98 to initiate a game play, and stop each reel 98 to display a plurality of symbols 88 associated with the randomly generated outcome. In addition, the gaming controller 16 is adapted to determine if the generated outcome is a winning outcome based on the displayed game symbols 88, a pay-table, a wager, and one or more selected paylines 100. More specifically, the gaming machine 10 determines if a combination of symbols 88 arranged along the selected payline 100 is a winning combination. The gaming controller 16 may provide an award in response to the outcome of the main game 80. In general, the term "award" may be a payout, in terms of credits or money. Thus, gaming controller 16 may award a regular payout in response to the outcome of the main game 80. However, it should be noted that the term award may also refer to other types of awards, including, prizes, e.g., meals, show tickets, etc . . . , as well as in-game awards, such as free games or awarding the player one or more wild symbols or stacked wild symbols in each of the games.

The gaming controller 16 is configured to display the game 80 including a plurality of reels 98. For example, in one embodiment, the gaming controller 16 displays the game 80 having five reels 98 orientated horizontally including a $1^{st}$ reel 102, a $2^{nd}$ reel 104, a $3^{rd}$ reel 106, a $4^{th}$ reel 108, and a $5^{th}$ reel 110. Each reel 98 may have a plurality of associated reel strips 82 that may be displayed on the respective reel 98. Each reel strip 82 includes a plurality of symbol positions 112. During display of the generated game outcome 84, the gaming controller 16 selects a reel strip 82 to be displayed on at least one of the reels 98, selects a plurality of game symbols 88 being displayed in each of the symbol positions 112 of each selected reel strip 82, and spins each reel 98 such the game symbols 88 are moved through each of the cells 92 in the display area 86.

The gaming controller 16 randomly selects one of the first reel strip 118, the second reel strip, and the third reel strip 122 and displays the selected reel strip 82 with the first reel 102. In addition, the gaming controller 16 may randomly select at least one special symbol 130 from a plurality of special symbols including a predefined set of special symbols 130 and displays the selected special symbol 130 displayed within each special symbol position 114. The gaming controller 16 spins and stops the first reel 102 to display the generated game outcome 84 within the display area 86 including the selected reel strip 82 having the selected special symbol 130 being displayed in each special symbol position 114.

The illustrated embodiment can also include a bonus feature or secondary game in addition to the main game on the gaming machine. The bonus feature or secondary game is an add-on to the main game utilizing any in-game machine asset (discussed in more detail below). A bonus feature or secondary game is considered an add-on to the main game that occurs during game play. The bonus feature or secondary game can used any in-game machine asset that is used to display an award related to the main game. Such awards include free spins, credits, a credit multiplier, or additional pseudo game-play unrelated to the main game. The bonus feature or secondary game can be in any of the wagering or non-wagering formats as described above (slots, video poker, etc.). A bonus feature or secondary game may also be similar to the main game through the use of additional random numbers in order to continue randomized, wager-based game play. A bonus feature or secondary game may include any additional game play and grant awards based on any particularized triggers built into the main game of the game machine. It should be noted that the game may only include the main game 80. Alternatively, the game may include the main game 80 and one or more bonus features and/or one or more secondary games. It should be noted that the present invention is not limited to any specific bonus feature or secondary game (or type thereof). Exemplary bonus features or secondary games are disclosed in U.S. Pat. Nos. 7,824,260, 8,052,515, 8,096,869, 8,303,397, and United States Patent Application Publication 2011/0223985, all of which are hereby incorporated by reference.

Figure 8:
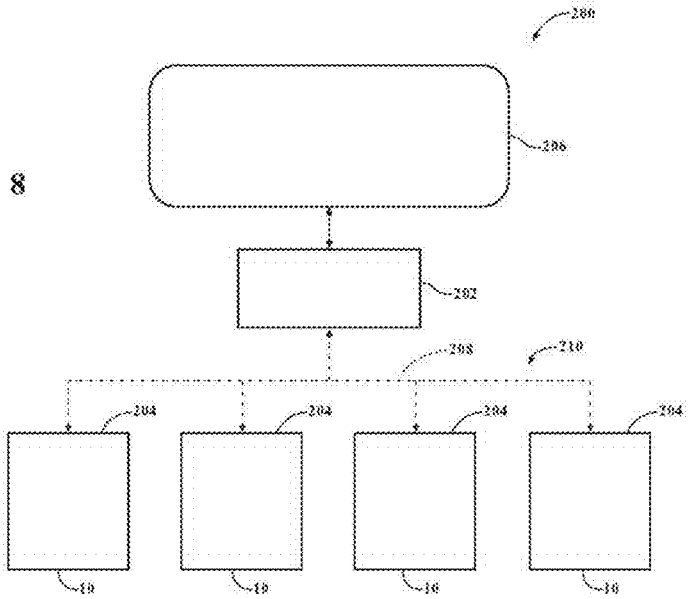
FIG. 8 is a schematic view of an exemplary gaming system of the present invention.

FIG. 8 is a schematic view of an exemplary gaming system 200. The gaming system 200 includes a system controller 202 and one or more gaming terminals 204 that are coupled to the system controller 202. The gaming system 200 may also include a central display 206 that is coupled to the system controller 202 for displaying games played on one or more of the gaming machines 10. In one embodiment, the gaming terminal 204 includes the gaming machine 10. In another embodiment, gaming terminal 204 may include a personal computer, laptop, cell phone, smartphone, tablet computer, personal data assistant, and/or any suitable computing device that enables a player to connect to system controller 202 to play the game 80.

Figure 9:
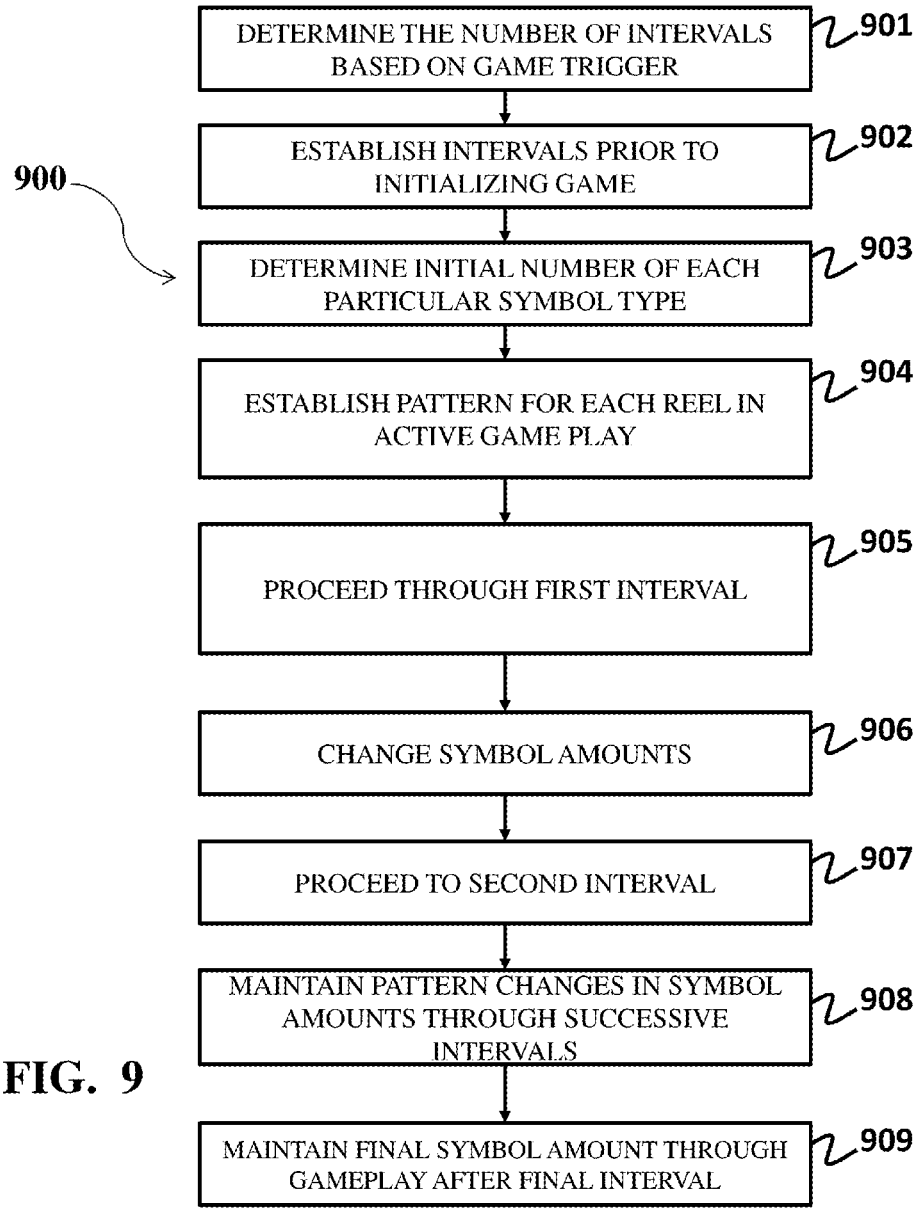
FIG. 9 is a flowchart of an exemplary method of allowing a player to play a gaming machine, according to an embodiment of the present invention.

In the illustrated embodiment, the gaming machines 10 and the system controller 202 are coupled in communication with a local area network (LAN) 208. Alternatively, the gaming machines 10 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming machines 10, which in one embodiment as shown in FIG. 9 are arranged in a bank 210, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In one embodiment, the system controller 202 may be implemented by one of the gaming controllers 16 associated with a gaming machine 10. In still another embodiment, the system controller 202 may be located remotely with respect to gaming machines 10, or within one of the gaming machine cabinet assemblies 18 (shown in FIG. 1). The system controller 202 is configured to perform all of the functions of the gaming controller 16 as described herein.

In the illustrated embodiment, the system controller 202 determines if a triggering event occurs in a game outcome being played at one or more of the gaming machines 10, and displays a bonus game such as, for example, the game 80 on the central display 206 if the triggering event occurs. Alternatively, the system controller 202 may display the game 80 at one or more gaming machines 10 based on one or more triggering events occurring in games played at the gaming machines 10. The triggering event may be the appearance of a predefined symbol and/or a predefined symbol combination in a game outcome.

Referring to FIGS. 8 and 4, during play of the game 80, the system controller 202 determines a number of game outcomes, i.e., free spins that will be displayed based at least in part on the triggering event. The system controller 202 displays, for each bonus game 80, at least one reel 98 having a plurality of reel strips 82. Each reel strip 82 includes a plurality of special symbol positions 114 and a plurality of normal symbol positions 116, wherein the number of special symbol positions 114 in each reel strip 82 being different. The system controller 202 randomly selects one reel strip 82 of the plurality of reel strips 82 and displays the reel 98 with the selected reel strip 82 during the display of the game outcome.

Step/Interval Generation

In another aspect of the present invention, a system for providing a game to a player is provided. The game has a display configured to display a plurality of symbol positions 112 displayed on a grid 90. The grid defines a plurality of columns, each column having an associated reel 98, each reel having an associated reel strip 82, each reel strip including a plurality of symbol positions 112 and a plurality of gaming symbols 88 displayed in each of the symbol positions in a predetermined order defining a reel layout. The system is then further configured to: initiate a game; establish a first interval and a second interval within the game, each interval comprising at least two spins of the reels, where the reel strip associated with at least one of the reels has a first reel layout used during the spins of the first interval; and change the pattern of the reel strip of the at least one reel strip at the end of the first interval, prior to initiation of the second interval, to a second reel layout, wherein the second reel layout is used for the spins of the second interval.

In another aspect of the present invention, the intervals established by the system may consist of a predetermined number of free spins or a predetermined unit of time. If the interval is measured in time, the player may continue to activate the machine through the display 12, the counter/acceptor 28/26, or through the buttons 24 in order to initialize additional free spins during that interval. The intervals may also consist of an accumulated amount of won credits currently held by the gaming machine 10 for the player during gameplay. Such credits may be locally based within the gaming machine 10 or system based within a system in communication with the gaming machine 10.

In another aspect of the present invention, the system may be configured to maintain the patterns used by the reels 98 during the final interval throughout the rest of the player's game play.

In another aspect of the present invention, the first reel layout can include a first number of a first gaming symbol and a first number of a second gaming symbol. Then, the second reel layout can also include a first number of a first game symbol and a first number of a second game symbol. Both reel layouts have a total number of gaming symbols that is equal.

In another aspect of the present invention, the second number of the first gaming symbol in the second reel layout is greater than the first number of the first gaming symbol.

In another aspect of the present invention, the first gaming symbol is added to the second reel layout in a plurality of adjacent symbol positions. The plurality of adjacent symbol positions being equal to the difference between the first number and the second number. These adjacent symbol positions can be predetermined and can also be uniform from interval to interval or can contain different amounts of gaming symbols.

In another aspect of the present invention, the second gaming symbols in the first reel layout and the second reel layout are located in predetermined, adjacent symbol positions.

In another aspect of the present invention, the plurality of adjacent symbol positions are placed at an insertion point on the reel strip of the first reel layout and alter the symbol position of surrounding gaming symbols on the reel strip of the second reel layout.

In another aspect of the present invention, the plurality of adjacent symbol positions are placed at an insertion point on the reel of the first reel layout and replace the symbols in the surrounding symbol position on the reel strip of the second reel layout.

Referring to FIG. 9, the method of generating the intervals over the course of game play is illustrated. The gaming machine 10 begins in regular gameplay with a player as described in the sections above. A game trigger may be used in order to initialize the method at step 901. The trigger can be an activation of the machine through the display 12, the counter/acceptor 28/26, or through the buttons 24. The trigger may also be an in-game feature based on a particular combinations of symbols predetermined within the gaming machine 10. Finally, the trigger may also be a system trigger through the system controller 202 in communication with the game machines 10. Through receipt of any of the trigger signals discussed, the game machine will determine the number of steps or intervals required for continued game play based on the trigger that is received.

At step 902, the game machine 10 will establish the steps or intervals necessary for the implementation of the symbols and reel layout patterns. A step or interval is a unit used within the method where particular reel layout is implemented across at least one reel. A step or interval may comprise a predetermined series of free spins as well as a predetermined amount of time. If the interval is measured in time, the player may continue to activate the machine through the display 12, the counter/acceptor 28/26, or through the buttons 24 in order to initialize additional free spins during that interval. The intervals may also consist of an accumulated amount of won credits currently held by the gaming machine 10 for the player during gameplay. Such credits may be locally based within the gaming machine 10 or system based within a system in communication with the gaming machine 10.

According to the present embodiment, the game machine 10 will then determine the base amount of symbols and/or symbol types at step 903. As discussed along with FIG. 5, the game machine contains a plurality of reel strips 82, each reel strip containing a plurality of symbols and symbol positions. These elements together make a reel layout. In order to proceed through multiple reel layouts over the course of multiple intervals, the game machine will set initial symbol amounts and positions based on the pattern for each reel. A symbol amount is defined as the number of symbols in a particular reel strip 98. At step 904, the game machine will then establish multiple patterns of reel layouts prior to initiation of the first interval of game play. At least 2 patterns will be utilized together as the reels spin from interval to interval. Each reel 98 will have an established pattern at step 904 and will continue through that pattern thought the remaining intervals established by the gaming machine 10. At step 905, the reels will spin through their first interval utilizing their initial symbol amounts and patterns. The reels may begin with the same initial reel layout or may have different initial layouts. Upon completion of the first interval at step 905, each reel strip will change to a new reel layout according to their determined pattern. Two exemplary embodiments of these reel patterns will be discussed in further detail below.

At step 906 and 909, the reel layout will change the quantity and position of the symbols within the reel layout as discussed above and continue until the end of the final interval established by the gaming machine 10.

FIG. 6 illustrates are embodiments of the pattern used by the gaming machine 10. This illustrated embodiment contains two main symbol types of gaming symbols 88 that are relevant to the development of the reel layout pattern. First, a wild symbol type 601 is established at step 903. This symbol type may consist of a single symbol or a plurality of similar symbols in accordance with the branding, design or themes within game machine 10. Any of the symbols presented within FIG. 5 are available for the use as this symbol type without limitation. Furthermore, the wild symbol type 601 may be initially established as a single symbol or as an adjacent wild symbol group 602. This again will depend on the predetermined mechanics of the game machine 10.

Second, an inner symbol type 603 is also established by the gaming machine 10 at step 903. This symbol type may consist of a single symbol or a plurality of similar symbols in accordance with the branding, design or themes within game machine 10. Any of the symbols presented within FIG. 5 are available for the use as this symbol type without limitation. Furthermore, the inner symbol type 603 may be initially established as single symbol or as an adjacent inner symbol group 604. This again will depend on the predetermined mechanics of the game machine 10.

As demonstrated in the illustrated embodiments both the wild symbols 601 and the inner symbols 603 progressively change their perspective quantities as the game machine 10 progresses thru the established intervals. In this particular embodiment the wild symbols add another adjacent symbol group 602A as the reel strip progresses from interval/step 1 to interval/step 2. Also, the inner symbols 603 decrease by the same amount as the wild symbols 601 as the reel strip progresses from interval/step 1 to interval/step 2. The amount of change between the wild symbols 601 and the inner symbols 603 can be predetermined for all steps or for individual steps depending on the trigger received by the gaming machine 10. This amount of change is such that the overall length of the reel strip is maintained across all intervals in the invention.

As the reel layout in FIG. 6 progresses through the intervals, the position of remaining symbols 607 change by the changing quantities of wild symbol 601 and inner symbols 603. The remaining symbols 607 may consist of a single symbol or a plurality of similar symbols in accordance with the branding, design or themes within game machine 10. Any of the symbols presented within FIG. 5 are available for the use as this symbol type without limitation. As shown in FIG. 6, each addition group of adjacent wild symbols 602 B-D is inserted into the reel strip at a respective insertion point 605. As the wild symbol group is inserted, remaining symbols 606 are displaced from their previous positions on the reel strip, leaving groups of remaining symbols 607. These remaining groups of symbols may be predetermined or random in size according the design and mechanics of the game machine 10. Also, the inner symbols 603 may maintain their adjacent positions as the reel strip progresses through the intervals. This creates an adjacent inner symbol group 604 that decreases in size as the reel strip progresses thru the intervals of the invention.

FIG. 7 presents an alternate example of how to change symbols or symbol types between intervals over the course of a game. In this illustrated embodiments, the wild symbols 601 and the remaining symbols 606 alter their quantities as the reel strip progresses thru the steps. The inner symbols 603 maintain their quantity and symbol positions on the reel strip as the inner symbol adjacent group 604.

Progressing through each interval in the embodiment shown in the FIG. 7, the remaining symbols 606 are not displaced but overwritten by the increasing wild symbols 601. With each interval, a group of adjacent wild symbols 602 A is inserted at a respective insertion point 605. Surrounding remaining symbols 606 are overwritten, leaving groups of remaining symbol 607 as they are inserted at the completion of each step. Again the groups of remaining symbols 607 may be predetermined or random in size depending on the mechanics or the game within the gaming machine 10.

Finally, referring back to FIG. 9, the system will continue with the last set of patterns created during the final interval established by the gaming machine through the remainder of the player's game play.

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A system, comprising:

an acceptor device configured to accept physical media indicative of a monetary value to establish a credit balance;

a game coupled to the acceptor device and having a display configured to display a plurality of symbol positions displayed in a grid, the grid defining a plurality of columns, each column having an associated reel, each reel having an associated reel strip, each reel strip including a plurality of symbol positions and a plurality of game symbols displayed in each of the symbol positions in a predetermined order defining a reel layout, wherein the game machine is further configured to:

initiate a game;

establish a first interval and a second interval within the game, wherein each interval comprises at least two spins of the reels, wherein the reel strip associated with at least one of the reels has a first reel layout used during the at least two spins of the first interval; and change the pattern of the reel strip of the at least one reel strip at the end of the first interval, prior to initiation of the second interval, to a second reel layout, wherein the second reel layout is used for the at least two spins of the second interval, wherein each interval consists of a predefined number of spins, the game further including a final interval, the method further comprising the step of maintaining the reel layout used in a previous interval in the final interval, wherein the first reel layout includes a first number of a first game symbol and a first number of a second game symbol, the second reel layout includes a second number of the first game symbol and a second number of the second game symbol, and a total number of symbol positions in the first reel layout and the second reel layout that is equal, where the second number of the first game symbol in the second reel layout is greater than the first number of the first game symbol, where the first symbol is added to the second reel layout in each of a plurality of adjacent symbol positions, the plurality of adjacent symbol positions being equal to the difference between the first number and the second number.

2. The system of claim 1, where the second symbols in the first reel layout and the second reel layout are located in predetermined, adjacent symbol positions.

3. The system of claim 2, where the plurality of adjacent symbol positions are placed at an insertion point on the reel strip of the first reel layout and alter the symbol position of surrounding symbols on the reel strip of the second reel layout.

4. The system of claim 3, where the plurality of adjacent symbol positions are placed at an insertion point on the reel of the first reel layout and replace the symbols in the surrounding symbol position on the reel strip of the second reel layout.

5. A method of providing a game to a player on a gaming device, the gaming device having an acceptor device and a display, the display being configured to display a plurality of symbol positions displayed in a grid, the grid defining a plurality of columns, each column having an associated reel, each reel having an associated reel strip, each reel strip including a plurality of symbol positions and a plurality of game symbols displayed in each of the symbol positions in a predetermined order defining a reel layout, comprising the steps of:

accepting physical media indicative of a monetary value and establishing a credit value;

initiating, by a processor of a gaming system, a game;

establishing, by the processor, a first interval and a second interval within the game, wherein each interval comprises at least two spins of the reels, wherein the reel strip associated with at least one of the reels has a first reel layout used during the at least two spins of the first interval; and changing, by the processor, the pattern of the reel strip of the at least one reel strip at the end of the first interval, prior to initiation of the second interval, to a second reel layout, wherein the second reel layout is used for the at least two spins of the second interval, the game further including a final interval, further comprising the step of maintaining the reel layout used in a previous interval in the final interval, wherein the first reel layout includes a first number of a first game symbol and a first number of a second game symbol, the second reel layout includes a second number of the first game symbol and a second number of the second game symbol, and a total number of symbol positions in the first reel layout and the second reel layout that is equal, where the second number of the first game symbol in the second reel layout is greater than the first number of the first game symbol, where the first symbol is added to the second reel layout in each of a plurality of adjacent symbol positions, the plurality of adjacent symbol positions being equal to the difference between the first number and the second number.

6. The method of claim 5, where the second symbols in the first reel layout and the second reel layout are located in predetermined, adjacent symbol positions.

7. The method of claim 6, where the plurality of adjacent symbol positions is placed at an insertion point on the reel strip of the first reel layout and change the symbol position of surrounding symbols on the reel strip of the second reel layout.

8. The method of claim 7, where the plurality of adjacent symbol positions is placed at an insertion point on the reel of the first reel layout and replace the symbols in the surrounding symbol position on the reel strip of the second reel layout.

9. A non-transitory information recording medium on which a computer readable program is recorded that causes a computer to function as a system comprising:

an acceptor device configured to accept physical media indicative of a monetary value to establish a credit balance;

a game having a display configured to display a plurality of symbol positions displayed in a grid, the grid defining a plurality of columns, each column having an associated reel, each reel having an associated reel strip, each reel strip including a plurality of symbol positions and a plurality of game symbols displayed in each of the symbol positions in a predetermined order defining a reel layout, wherein the game machine is further configured to:

initiate a game;

establish a first interval and a second interval within the game, wherein each interval comprises at least two spins of the reels, wherein the reel strip associated with at least one of the reels has a first reel layout used during the at least two spins of the first interval; and change the pattern of the reel strip of the at least one reel strip at the end of the first interval, prior to initiation of the second interval, to a second reel layout, wherein the second reel layout is used for the at least two spins of the second interval, the game further including a final interval, the game machine further configured to maintain the reel layout used in a previous interval in the final interval, wherein the first reel layout includes a first number of a first game symbol and a first number of a second game symbol, the second reel layout includes a second number of the first game symbol and a second number of the second game symbol, and a total number of symbol positions in the first reel layout and the second reel layout that is equal, where the second number of the first game symbol in the second reel layout is greater than the first number of the first game symbol, where the first symbol is added to the second reel layout in each of a plurality of adjacent symbol positions, the plurality of adjacent symbol positions being equal to the difference between the first number and the second number.

* * * * *